US012601180B2

(12) United States Patent
Grimsey

(10) Patent No.: US 12,601,180 B2
(45) Date of Patent: Apr. 14, 2026

(54) STAIRCASE WHEELCHAIR RAMP ASSEMBLY

(71) Applicant: Michael Grimsey, Huntington Station, NY (US)

(72) Inventor: Michael Grimsey, Huntington Station, NY (US)

( * ) Notice: Subject to any disclaimer, the term of this patent is extended or adjusted under 35 U.S.C. 154(b) by 508 days.

(21) Appl. No.: 18/447,531

(22) Filed: Aug. 10, 2023

(65) Prior Publication Data

US 2025/0052067 A1 Feb. 13, 2025

(51) Int. Cl.
*E04F 11/00* (2006.01)

(52) U.S. Cl.
CPC ..... *E04F 11/002* (2013.01); *E04F 2011/005* (2013.01)

(58) Field of Classification Search
CPC ..... E04F 11/002; E04F 2011/005; E04F 2011/007
USPC ..... 414/921; 14/71.1
See application file for complete search history.

(56) References Cited

U.S. PATENT DOCUMENTS 5,050,708 A * 9/1991 Wood ..... B66B 9/0838 187/201
5,319,818 A * 6/1994 Baranowski ..... A61G 3/061 14/71.1
7,537,069 B2 * 5/2009 Kramer ..... A47K 17/022 180/21
8,332,981 B2 * 12/2012 Woo ..... E04F 11/002 193/38
9,469,507 B2 * 10/2016 Awerbuch ..... B66B 9/0846
9,587,405 B1 * 3/2017 Alhazza ..... E04F 11/002
2024/0117637 A1 * 4/2024 Sayapin ..... E04F 11/002

FOREIGN PATENT DOCUMENTS

DE 202021102530 U1 * 7/2021 ..... E04F 11/002
KR 200373393 Y1 * 1/2005 ..... E04F 11/002
KR 101717958 B1 * 3/2017
KR 101797389 B1 * 11/2017 ..... E04F 11/002
RU 194558 U1 * 12/2019 ..... A61G 5/02

* cited by examiner

*Primary Examiner* — Gary S Hartmann
(74) *Attorney, Agent, or Firm* — Carter, DeLuca & Farrell LLP; Christopher G. Trainor

(57) ABSTRACT

A staircase wheelchair ramp assembly for transporting wheelchair bound occupants down a staircase includes a base platform and a ramp member. The base platform is supported adjacent to a staircase and is movable between a stowed position and a deployed position. In the deployed position, the base platform is positioned atop a staircase. The base platform supports inner and outer tracks that are configured to receive and guide inner and outer wheels of the wheelchair along the base platform over the staircase. The ramp member is pivotably coupled to one end of the base platform and is movable between a raised, substantially horizontal position and a lowered position supported on the base platform. The ramp member includes inner tracks that are aligned with the inner tracks of the base platform when the ramp member is in the lowered position.

20 Claims, 10 Drawing Sheets

STAIRCASE WHEELCHAIR RAMP ASSEMBLY

FIELD

This disclosure is directed to a wheelchair ramp assembly, and more specifically to a staircase wheelchair ramp assembly for expediting passage of wheelchair bound people in emergency situations.

BACKGROUND

Hospitals and elder multi-level living centers often have many wheelchairs bound occupants. Typically, ramps and elevators are provided in the living centers to allow the occupants to move between the different levels. In an emergency, such as a fire, it may be difficult or impossible to move all the occupants from the living center in an expedited fashion to avoid serious injury and/or death.

A continuing need exists in the art for a simple, cost-effective device that can be used in an emergency to expeditiously and safely transport wheelchair bound occupants down a staircase.

SUMMARY

This application is directed to a staircase wheelchair ramp assembly that is provided to allow wheelchair occupants to traverse a staircase quickly and safely during an emergency. The staircase wheelchair ramp assembly is movable between a stowed position in which the staircase wheelchair ramp assembly does not obstruct movement over the staircase and a deployed position in which the staircase wheelchair ramp assembly is positioned atop the staircase and is accessible to a wheelchair occupant. The staircase wheelchair ramp assembly includes a unique braking system that allows a wheelchair occupant to traverse a staircase in a controlled manner unassisted.

Aspects of the disclosure are directed to a staircase wheelchair ramp assembly including a base platform and a ramp member. The base platform has a first end portion, a second end portion, a top surface extending along the first end portion and the second end portion, a bottom surface extending along the first end portion and the second end portion, and side walls extending between the top surface and the bottom surface. The top surface supports outer tracks that extend along the length of the top surface and first inner tracks that are positioned between the outer tracks and extend along the top surface of the second end portion of the base platform. The outer tracks and the first inner tracks are configured to receive inner and outer wheels of a wheelchair. The ramp member is pivotably coupled to the first end portion of the base platform and has a top surface. The ramp member is movable between a raised position in which the ramp member projects outwardly over the top surface of the base platform and a lowered position in which the ramp member is supported on the top surface of the base platform. The ramp member supports second inner tracks that are aligned with the first inner tracks when the ramp member is in the lowered position, and the second inner tracks are configured to receive the inner wheels of the wheelchair.

In aspects of the disclosure, a biasing member positioned to urge the ramp member to the raised position.

In some aspects of the disclosure, the biasing member includes a V-shaped spring formed of spring steel.

In certain aspects of the disclosure, the outer tracks include an insert that is configured to frictionally engage the outer wheels of the wheelchair to limit a speed the wheelchair can roll through the outer tracks.

In aspects of the disclosure, the bottom surface of the base platform includes a padded layer.

In some aspects of the disclosure, the staircase wheelchair ramp assembly includes a hinge for securing one of the side walls of the base platform to a wall positioned adjacent a staircase such that the hinge facilitates movement of the staircase ramp assembly between a stowed position and a deployed position, wherein in the stowed position, the staircase wheelchair ramp assembly is positioned along the staircase and in the deployed position, the staircase wheelchair ramp assembly is positioned atop the staircase to allow the wheelchair to move along the base platform down the staircase.

In certain aspects of the disclosure, the staircase wheelchair ramp assembly includes a retainer that is engaged with the base platform to retain the staircase wheelchair ramp assembly in the stowed position.

In aspects of the disclosure, the retainer includes a grip portion that is positioned adjacent to the first end portion of the base platform.

In some aspects of the disclosure, the second inner tracks of the ramp member define a converging entry zone to guide the inner wheels of the wheelchair into the first inner tracks.

In aspects of the disclosure, one of the side walls of the base platform includes brackets that define openings that receive the retainer to retain the staircase wheelchair ramp assembly in the stowed position.

Other aspects of the disclosure are directed to a staircase wheelchair ramp assembly including a base platform, a hinge, and an insert. The base platform has a first end portion, a second end portion, a top surface extending along the first end portion and the second end portion, a bottom surface extending along the first end portion and the second end portion, and side walls extending between the top surface and the bottom surface. The top surface supports outer tracks that extend along the length of the top surface and first inner tracks that are positioned between the outer tracks and extend along the top surface of the second end portion of the base platform. The outer tracks and the first inner tracks are configured to receive inner wheels and outer wheels of a wheelchair. The hinge is provided for securing one of the side walls of the base platform to a wall positioned adjacent to a staircase. The hinge facilitates movement of the staircase ramp assembly between a stowed position and a deployed position, wherein in the stowed position, the staircase wheelchair ramp assembly is positioned along the staircase and in the deployed position, the staircase wheelchair ramp assembly is positioned atop the staircase to allow the wheelchair to move along the base platform down the staircase. The insert is received within the outer tracks and is configured to frictionally engage the outer wheels of the wheelchair to limit a speed the wheelchair can move through the outer tracks.

In aspects of the disclosure, a ramp member having a top surface is pivotably coupled to the first end portion of the base platform and is movable between a raised position in which the ramp member projects outwardly over the top surface of the base platform and a lowered position in which the ramp member is supported on the top surface of the base platform.

In some aspects of the disclosure, the ramp member supports second inner tracks that are configured to receive the inner wheels of the wheelchair and are aligned with the first inner tracks when the ramp member is in the lowered position.

In certain aspects of the disclosure, the biasing member is configured to allow the ramp member to move from the raised position to the lowered position upon a wheelchair being positioned on the ramp member.

Other features of the disclosure will be appreciated from the following description.

BRIEF DESCRIPTION OF THE DRAWINGS

Various aspects of the disclosed are described herein below with reference to the drawings, wherein.

DETAILED DESCRIPTION

Figure 1:
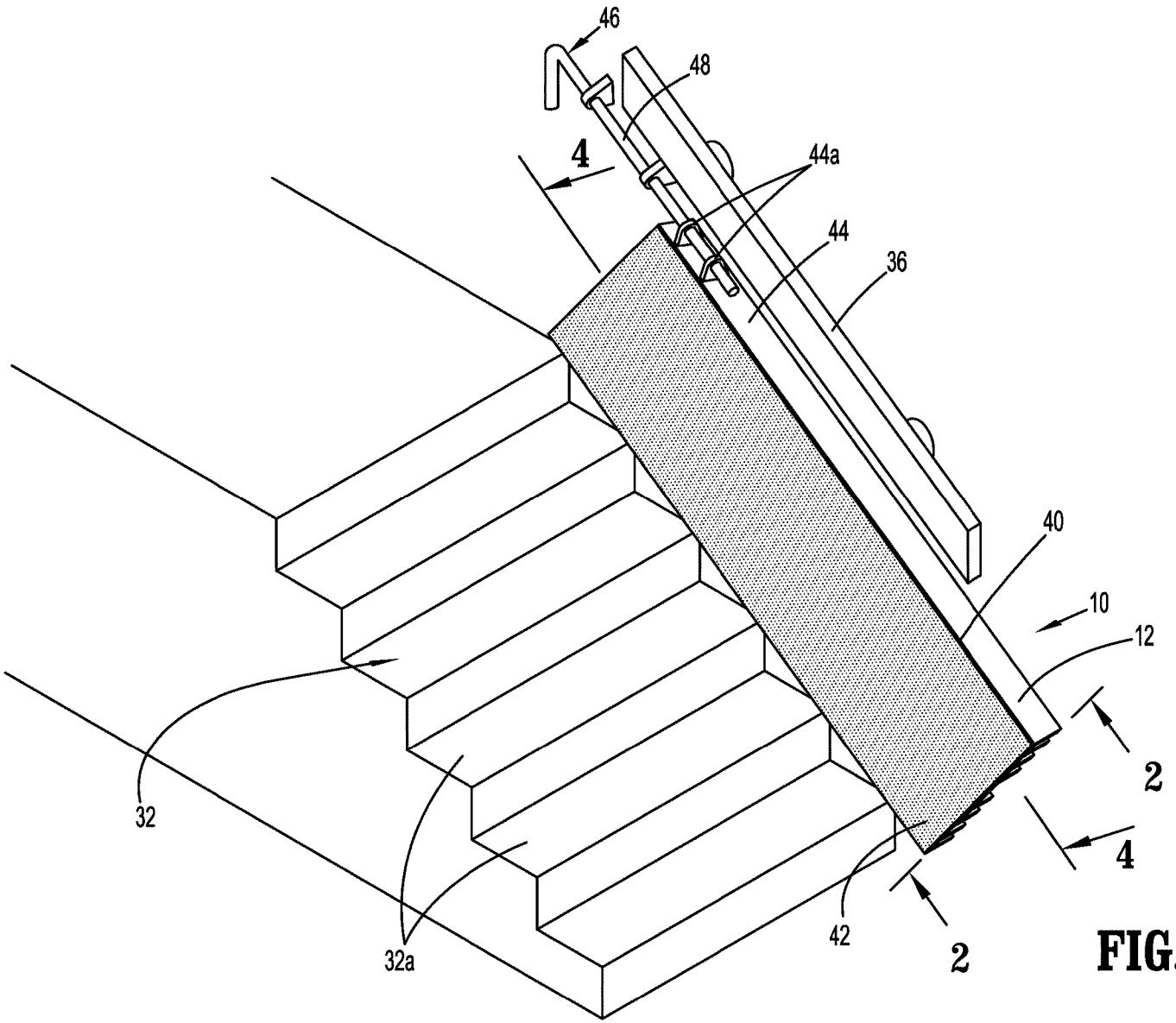
FIG. 1 is a side perspective view of the disclosed staircase wheelchair ramp assembly with the staircase wheelchair ramp assembly in a stowed position.
Figure 2:
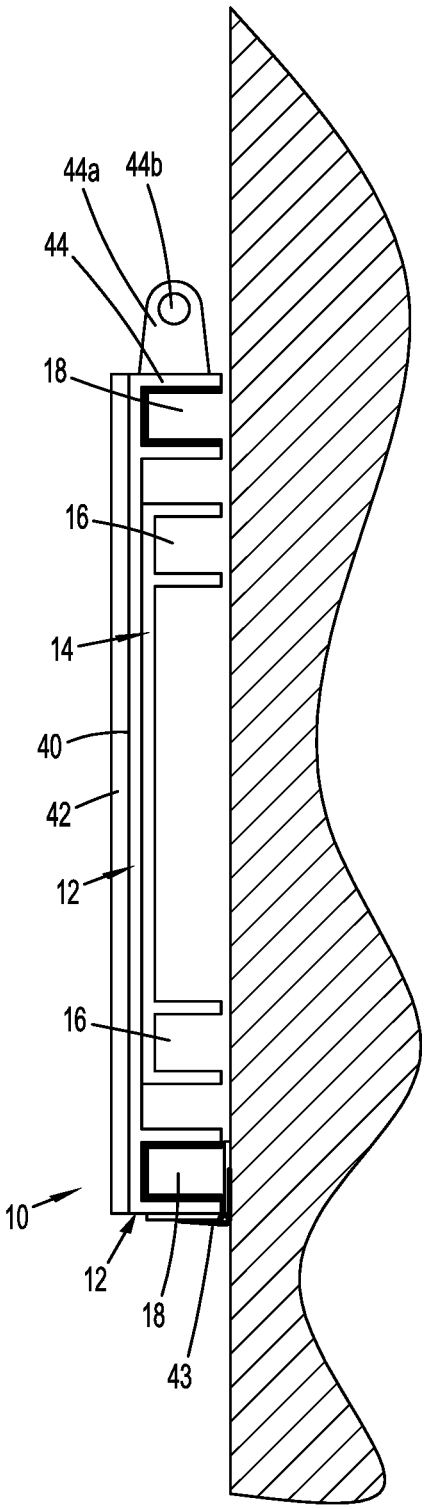
FIG. 2 is a cross-sectional view taken along section line 2-2 of FIG. 1.
Figure 3:
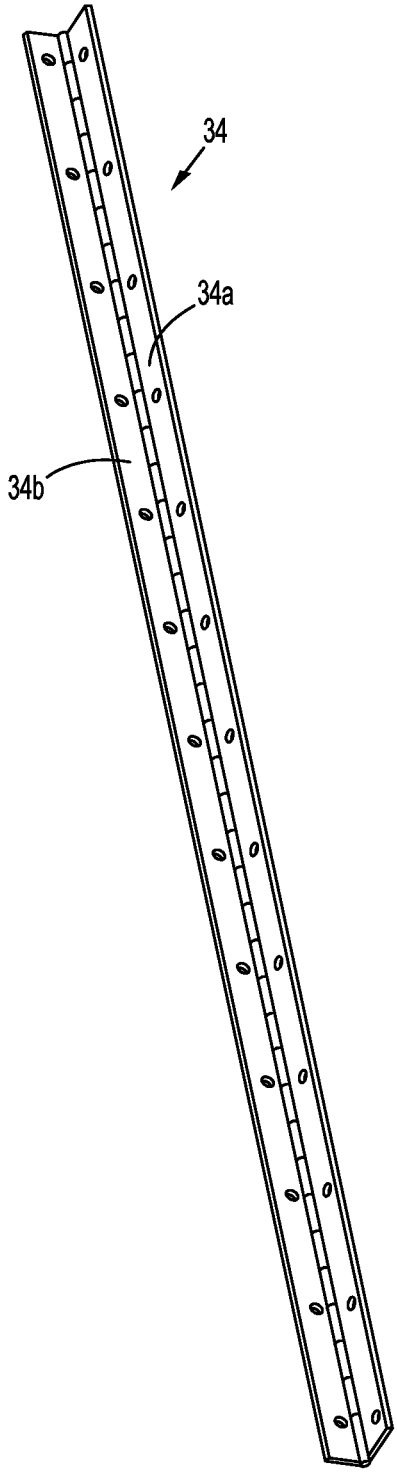
FIG. 3 is side perspective view of a hinge of the staircase wheelchair ramp assembly shown in FIG. 1.
Figure 4:
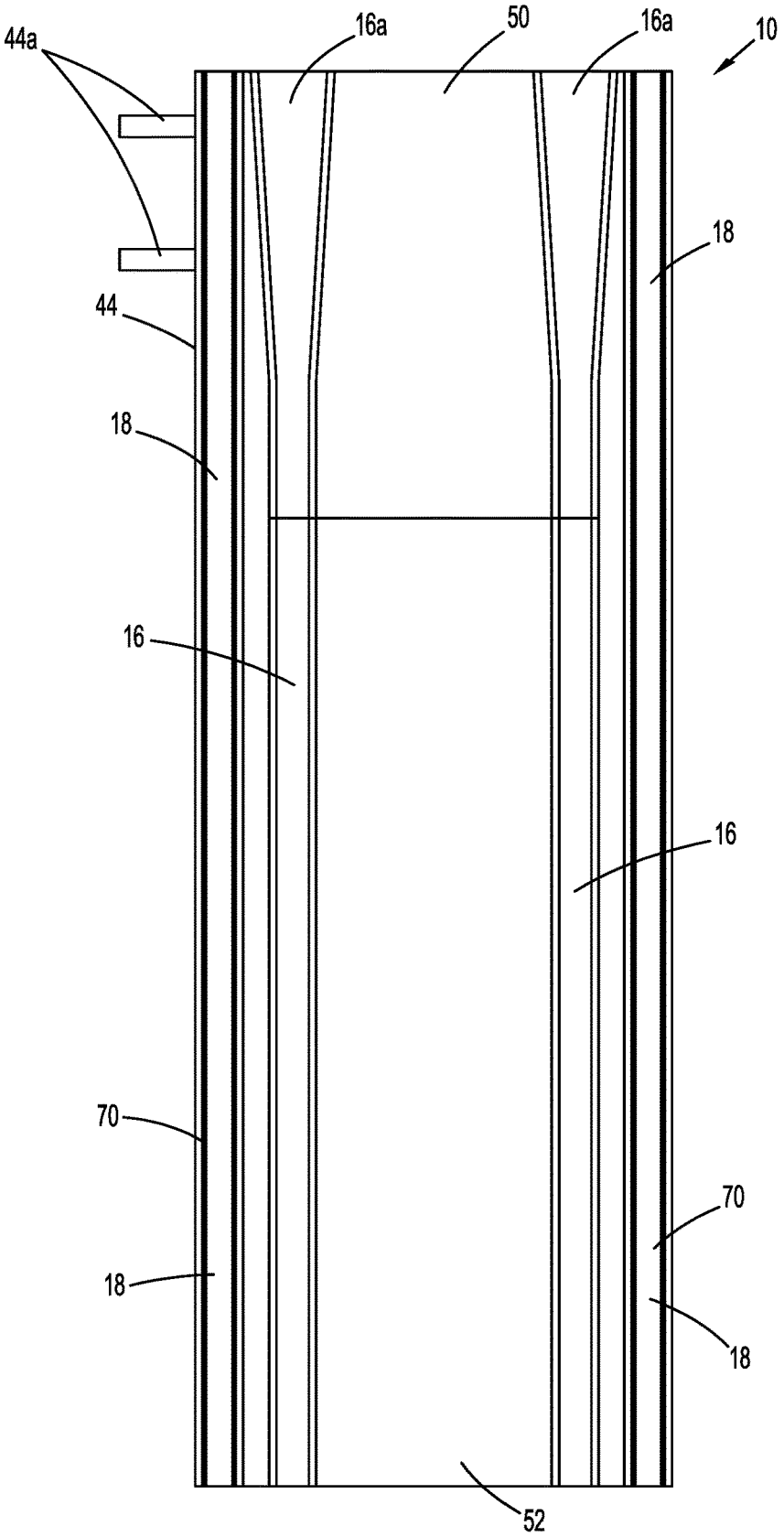
FIG. 4 is a plan view of a base platform on the staircase wheelchair shown in FIG. 1.

The disclosed staircase wheelchair ramp assembly will now be described in detail with reference to the drawings wherein like reference numerals designate identical or corresponding elements in each of the several views. However, it is to be understood that the aspects of the disclosure are merely exemplary of the disclosure and may be embodied in various forms. Well-known functions or constructions are not described in detail to avoid obscuring the disclosure in unnecessary detail. Therefore, specific structural and functional details disclosed herein are not to be interpreted as limiting, but merely as a basis for the claims and as a representative basis for teaching one skilled in the art to variously employ the disclosure in virtually any appropriately detailed structure.

In the application, directional terms such as front, rear, upper, lower, top, bottom, and similar terms are used to assist in understanding the description and are not intended to limit the disclosure.

This disclosure is directed to a staircase wheelchair ramp assembly that is provided to allow wheelchair occupants to traverse a staircase quickly and safely in an emergency. The staircase wheelchair ramp assembly is movable between a stowed position in which the staircase wheelchair ramp assembly does not obstruct movement over the staircase and a deployed position in which the staircase wheelchair ramp assembly is positioned atop the staircase and is accessible to a wheelchair occupant. The staircase wheelchair ramp assembly includes a unique braking system that allows a wheelchair occupant to traverse a staircase in a controlled manner unassisted.

FIGS. 1-4 illustrate aspects of the disclosed staircase wheelchair ramp assembly shown generally as wheelchair ramp assembly 10. The wheelchair ramp assembly 10 includes a base platform 12 and an inner support platform 14 that is secured to the base platform 12. The base platform 12 includes a top surface 28 (when deployed) (FIG. 5) that includes outer tracks 18 that are configured to receive the outer wheels 22 of a wheelchair 24 (FIG. 8), and the inner support platform 14 includes inner tracks 16 that are configured to receive the inner wheels 20 of the wheelchair 24. In aspects of the disclosure, the inner and/or the outer tracks 16, 18 can include a wide entry zone, e.g., a V-shaped entry zone 16*a*, that allows a wheelchair occupant to align the wheelchair 24 with the staircase wheelchair ramp assembly 10 and enter the upper end of the wheelchair tracks 16, 18.

The base platform 12 is pivotally secured to a wall 30 that is positioned on one side of a staircase 32 by an elongated hinge 34 (FIG. 3) to facilitate pivotable movement of the wheelchair ramp assembly 10 between a stowed position (FIG. 1) positioned in a vertical orientation beneath a banister 36 of the staircase 32 and a deployed position (FIG. 5) overlying steps 32*a* of the staircase 32. The hinge 34 has a first portion 34*a* secured to a wall supporting the banister 36 and the base platform 12 and a second portion 34*b* secured to the base platform 12. In aspects of the disclosure, the base platform 12 includes a bottom surface 40 that supports a foam, padded, or rubber layer 42 that allows the wheelchair ramp assembly 10 to move from the stowed position (FIG. 1) to the deployed position (FIG. 5) without damaging the staircase 32. In some aspects of the disclosure, the padded layer 42 is secured to the bottom surface 40 of the base platform 12 using adhesives or the like. It is also envisioned that a biasing member can be provided to urge the base platform 12 to the deployed position. In some aspects of the disclosure, the biasing member can be in the form of a torsion spring 43 (FIG. 3) incorporated into the hinge 34.

Figure 5:
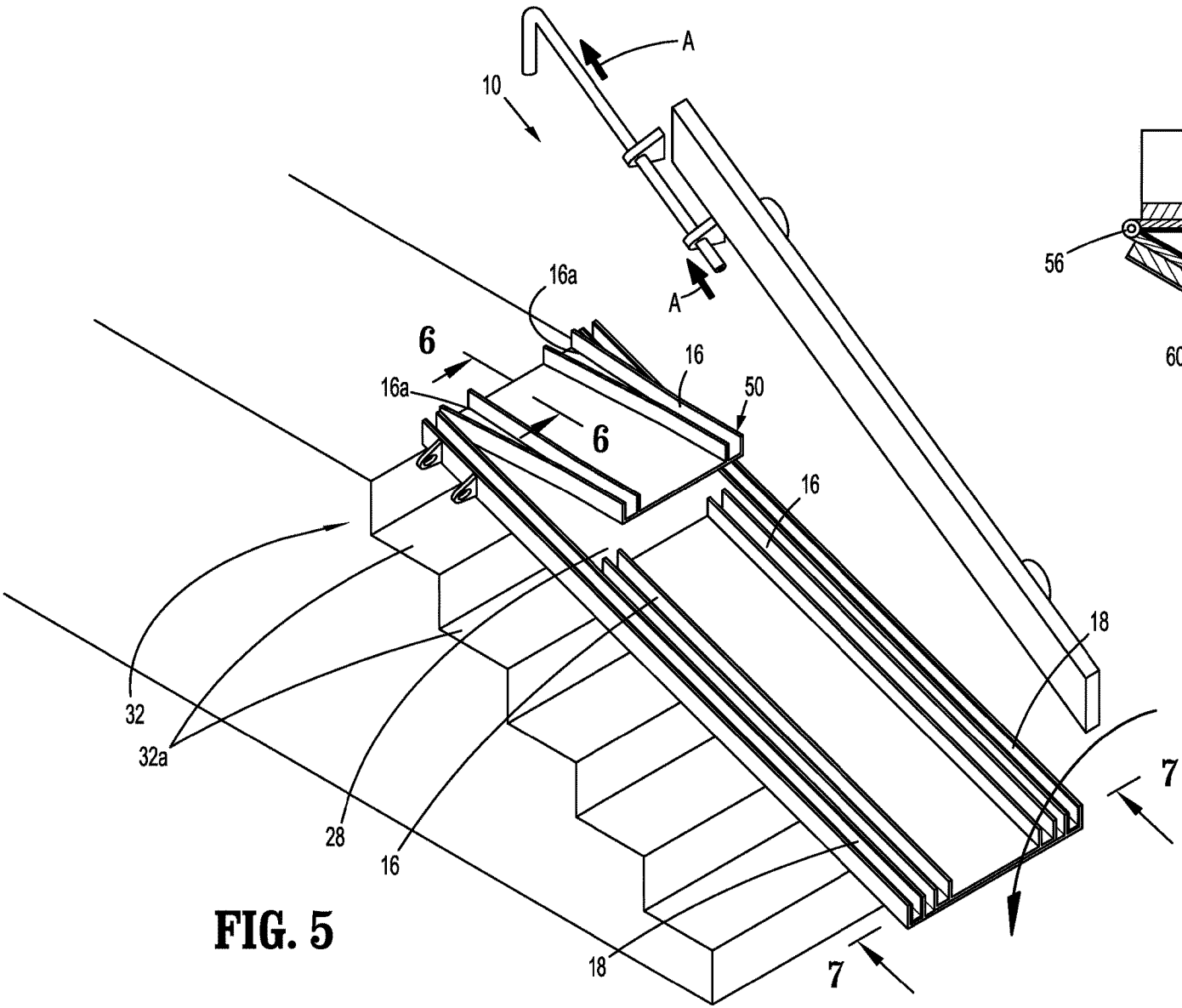
FIG. 5 is a side perspective view of the staircase wheelchair ramp assembly shown in FIG. 1 with the staircase wheelchair ramp assembly in a deployed position.

The base platform 12 includes a side walls 44. One of the side walls 44 includes or supports one or more brackets 44*a* (FIG. 2) that interact with a platform retainer 46 to retain the wheelchair ramp assembly 10 in the stowed position. In aspects of the disclosure, the brackets 44 define openings 44*b* and the retainer 46 includes an elongate rod 48 that is received within the openings 44*b* to retain the wheelchair ramp assembly 10 in the stowed position. The retainer 46 is slidable in the direction indicated by arrow "A" in FIG. 5 to remove the retainer 46 from the within the openings 44*a* to allow the wheelchair ramp assembly 10 to move to the deployed position (FIG. 5). The retainer can include a grip portion 45 that can be grasped by a wheelchair occupant to move the retainer 46 in the direction "A" to release the wheelchair ramp assembly 10. In some aspects of the disclosure, the wheelchair ramp assembly 10 moves from the stowed position to the deployed position under the force of gravity. Alternately, the wheelchair ramp assembly 10 can include a biasing member (not shown) to urge the wheelchair ramp assembly 10 from the stowed position to the deployed position.

Figure 6:
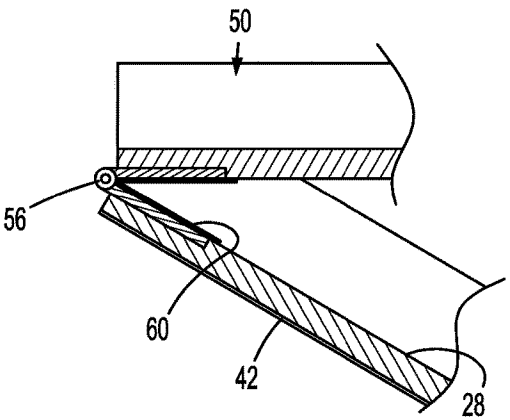
FIG. 6 is a cross-sectional view taken along section line 6-6 of FIG. 5.

FIGS. 5 and 6 illustrate the wheelchair ramp assembly 10 in the deployed position. The inner support platform 14 includes an upper portion or pivotable ramp member 50 and a lower portion 52 that each define the inner tracks 16. The lower portion 52 is fixedly secured to a lower portion of the top surface 28 of the base platform 12 between the outer tracks 18 (FIG. 5). The pivotable ramp member 50 of the inner support platform 14 forms a pivotable ramp member and is pivotally coupled to the upper end of the base platform 12 by a hinge 56 (FIG. 6) and is pivotable between a raised position (FIG. 1) and a lowered position (FIG. 5). In the raised position, the inner support platform 14 is substantially horizontal and extends outwardly from the top of the staircase 32 over the upper portion of the staircase 32 and the upper portion of the base platform 12. In the lowered position, the pivotable ramp member 50 of the inner support platform 14 is aligned with the lower portion 52 of the inner support platform 14 such that the inner tracks 16 of the pivotable ramp member 50 are aligned with the inner tracks 16 of the lower portion 52. It is envisioned that the pivotable ramp member 50, although shown as extending only over a portion of the staircase 32 could extend over the entire length of the staircase 32 or over any portion of the length of the staircase 32.

The wheelchair ramp assembly 10 includes a biasing member 60 that urges the pivotable ramp member 50 of the inner support platform 14 to the raised, horizontal position. In certain aspects of the disclosure, the biasing member 60 includes a V-shaped spring 62 (FIG. 6) formed of spring steel that is positioned between the pivotable ramp member 50 of the inner support platform 14 and the top surface 28 of the base platform 12. Alternately, other biasing member configurations are envisioned. For example, a piston could be positioned between the base platform 12 and the ramp member 50. The biasing member 62 should have a spring force to allow the pivotable ramp member 50 of the inner support platform 14 to move at a controlled rate from the raised position to a lowered position when a wheelchair occupant moves from the top of the staircase 32 onto the pivotable ramp member 50 of the inner support surface 14 of the wheelchair ramp assembly 10.

Figure 7:
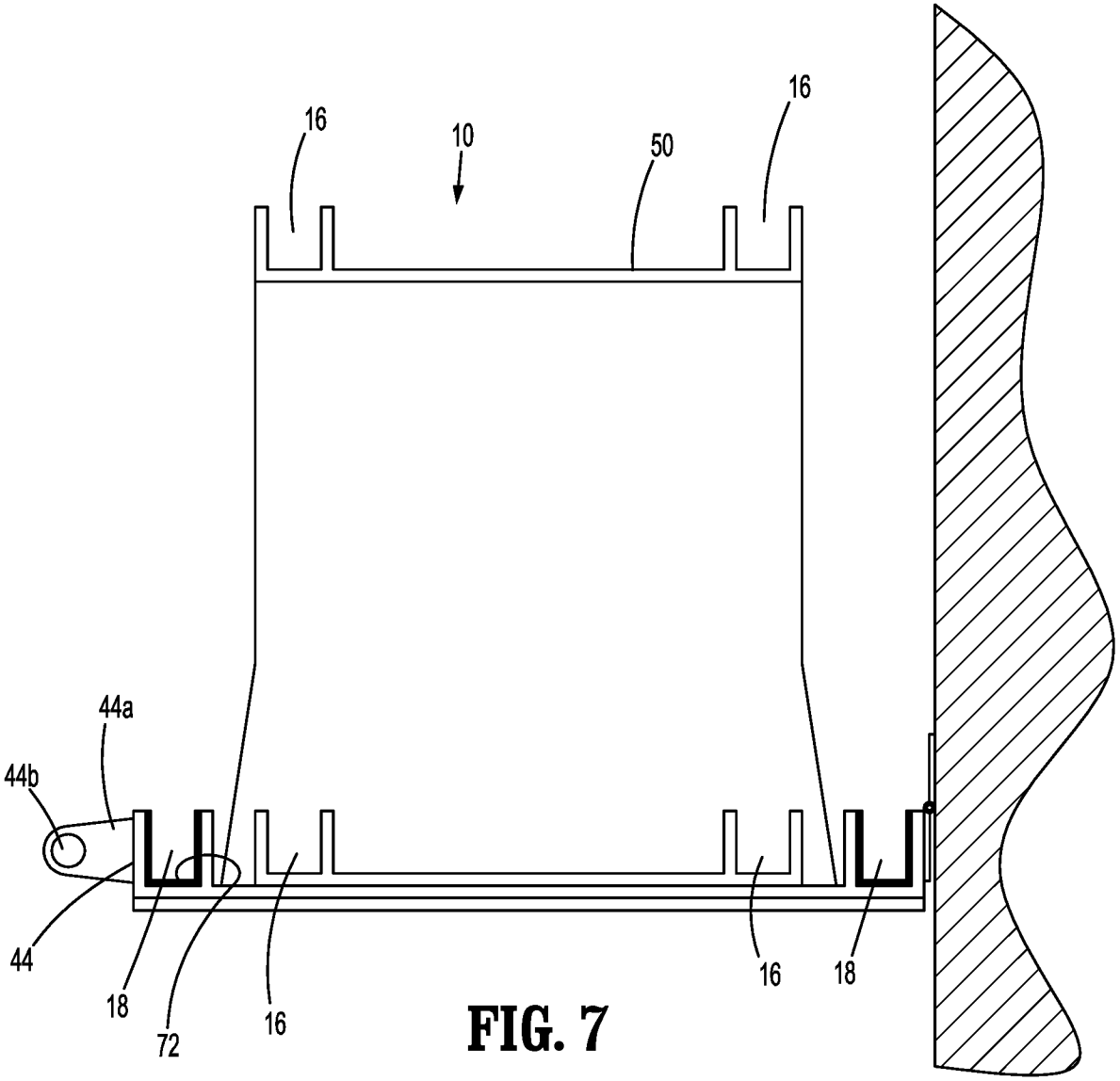
FIG. 7 is a view from a lower end of the staircase wheelchair ramp assembly shown in FIG. 5 in the deployed position with an inner support platform in a raised position.

FIG. 7 illustrates the wheelchair ramp assembly 10 looking up from the bottom of the staircase 32 with the wheelchair ramp assembly 10 in the deployed position and the upper portion of the inner support platform 14 in the raised position. As illustrated, the outer tracks 18 of the base platform 12 includes an insert 70 formed of a high resistance material that is configured to engage the outer wheels 22 of the wheelchair 24 to control the speed of the wheelchair 24 as the wheelchair 24 moves or rolls down the decline defined by the staircase 32. The insert 70 should define a channel 72 along the length of the base platform 12 within the outer tracks 18 that has a width that is smaller than the width of the outer wheels 22 of the wheelchair 24.

In aspects of the disclosure, the base platform 12 and the lower portion 52 of the inner support platform 14 can be integrally formed or constructed. More specifically, the inner tracks 16 in the lower portion 52 of the inner support platform 14 can be secured directly to the base platform 12.

Figure 8:
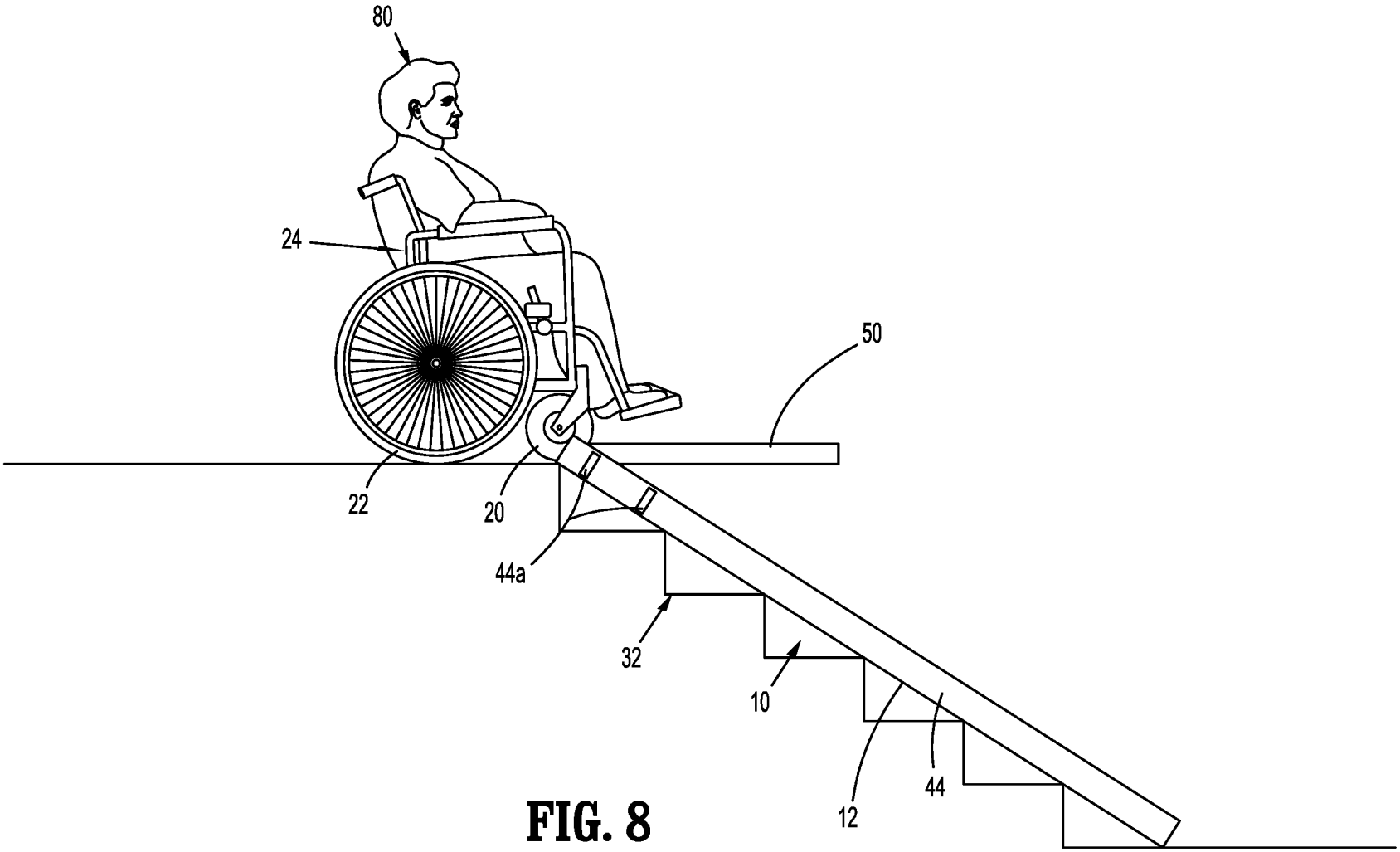
FIG. 8 is a side view of the staircase wheelchair ramp assembly shown in FIG. 6 in the deployed position with the inner support platform in the FIG. 7 is a view from a lower end of the staircase wheelchair ramp assembly shown in FIG. 5 in the deployed position with the inner support platform in the raised position.
Figure 9:
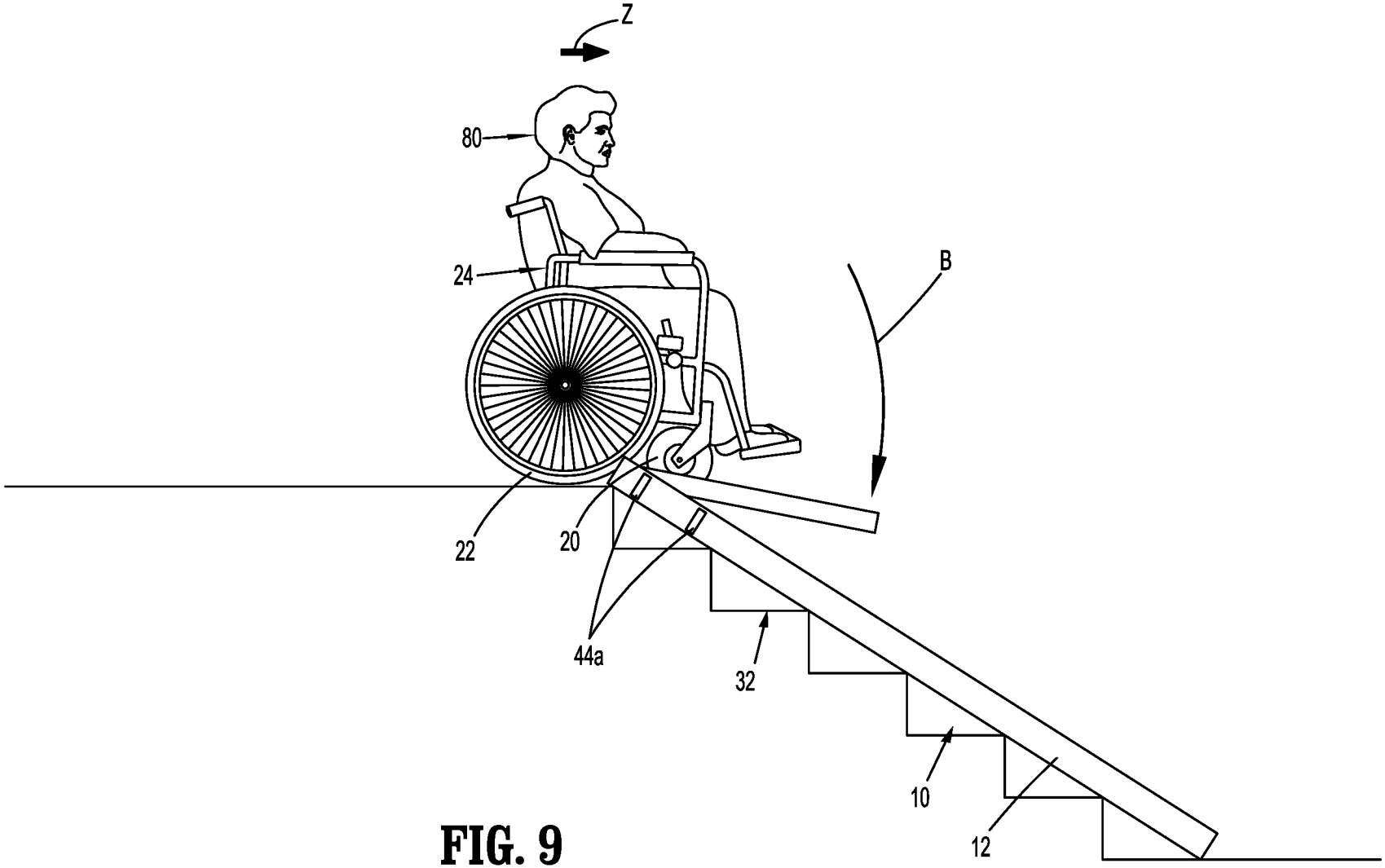
FIG. 9 is a side view of a wheelchair occupant as the wheelchair occupant begins to enter the staircase wheelchair ramp assembly shown in FIG. 8 with the staircase wheelchair ramp assembly in the deployed position with the inner support platform in the raised position.
Figure 10:
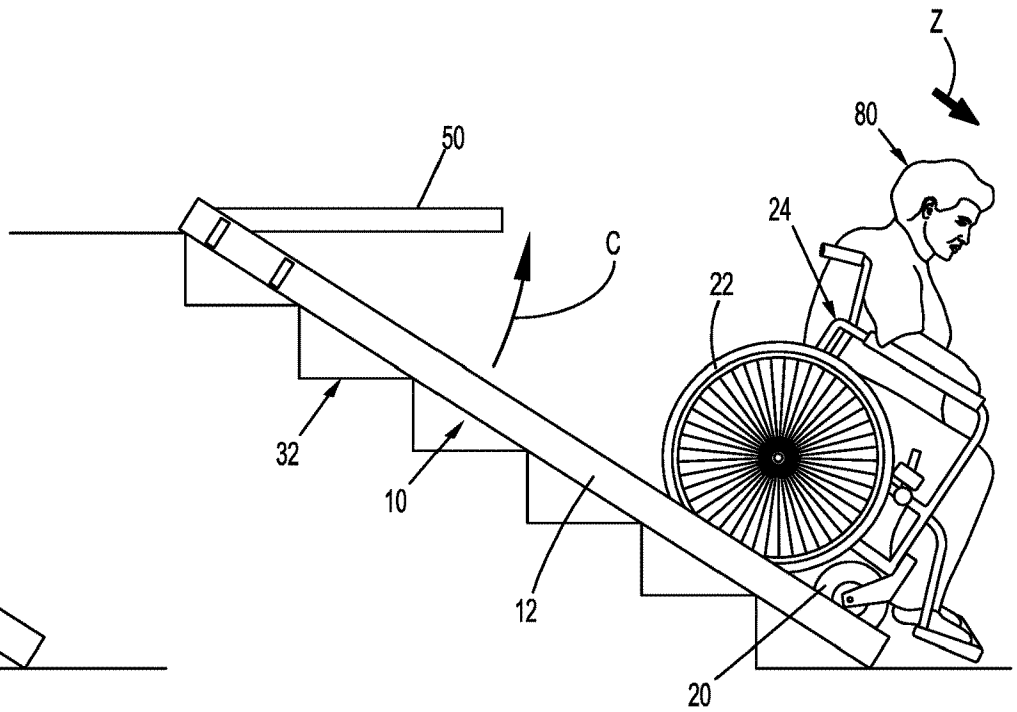
FIG. 10 is a side view of a wheelchair occupant as the wheelchair occupant begins to enter the staircase wheelchair ramp assembly shown in FIG. 8 with the staircase wheelchair ramp assembly in the deployed position with the inner support platform in a lowered position.
Figure 9A:
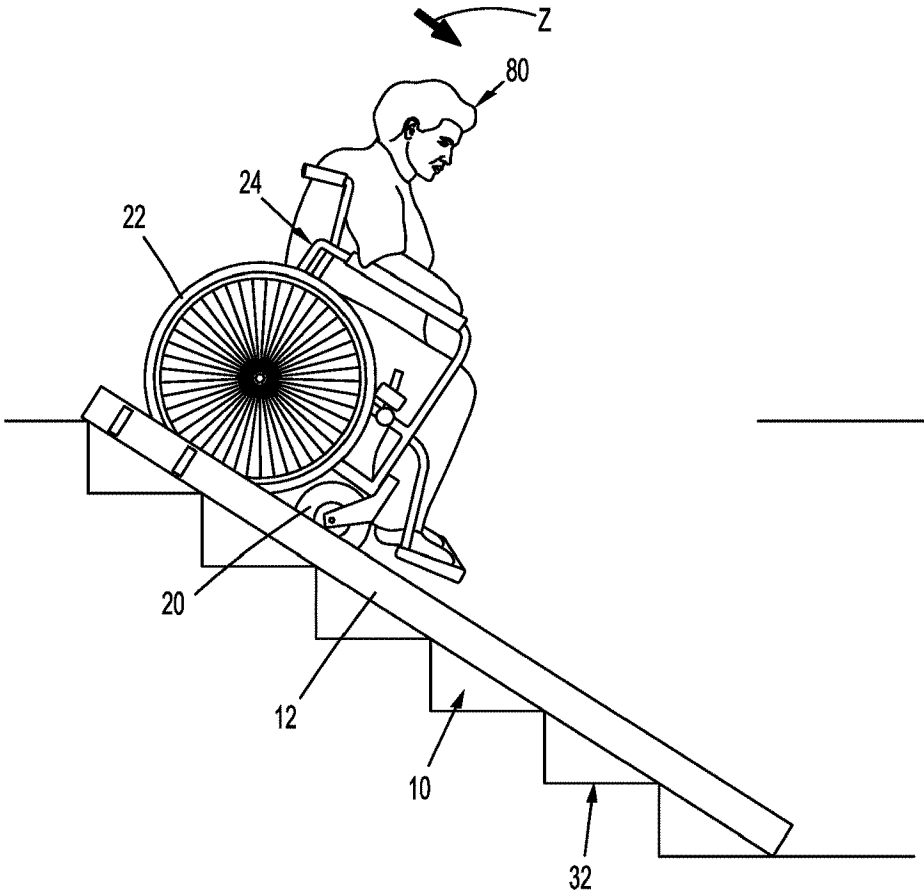
FIG. 9A is a side view of a wheelchair occupant as the wheelchair occupant moves onto the inner support platform shown in FIG. 9 with the staircase wheelchair ramp assembly in the deployed position and the inner support platform in the lowered position.
Figure 11:
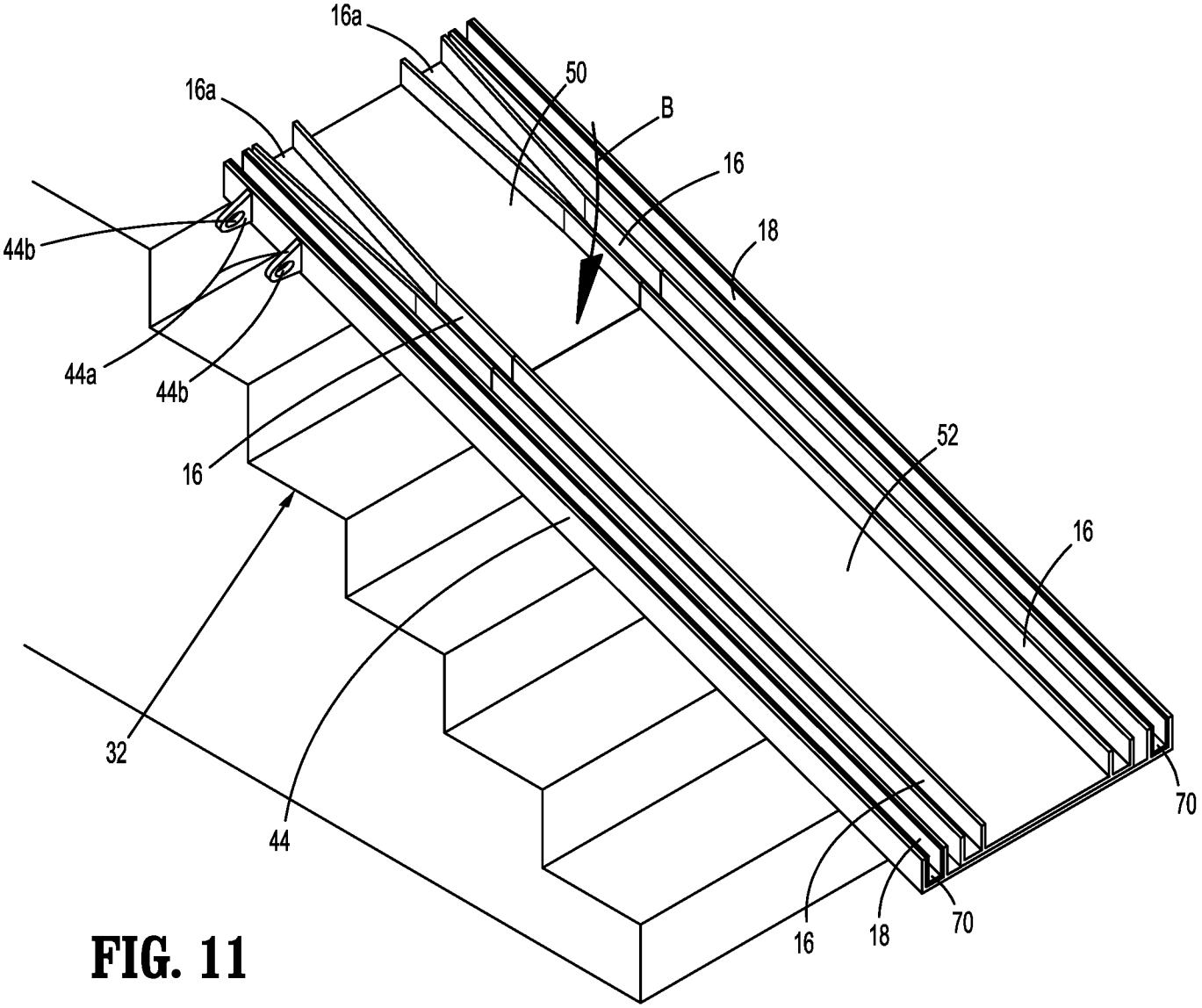
FIG. 11 is side perspective view of the staircase wheelchair ramp assembly shown in FIG. 10 with the staircase wheelchair ramp assembly in the deployed position and the inner support platform in the lowered position.
Figure 12:
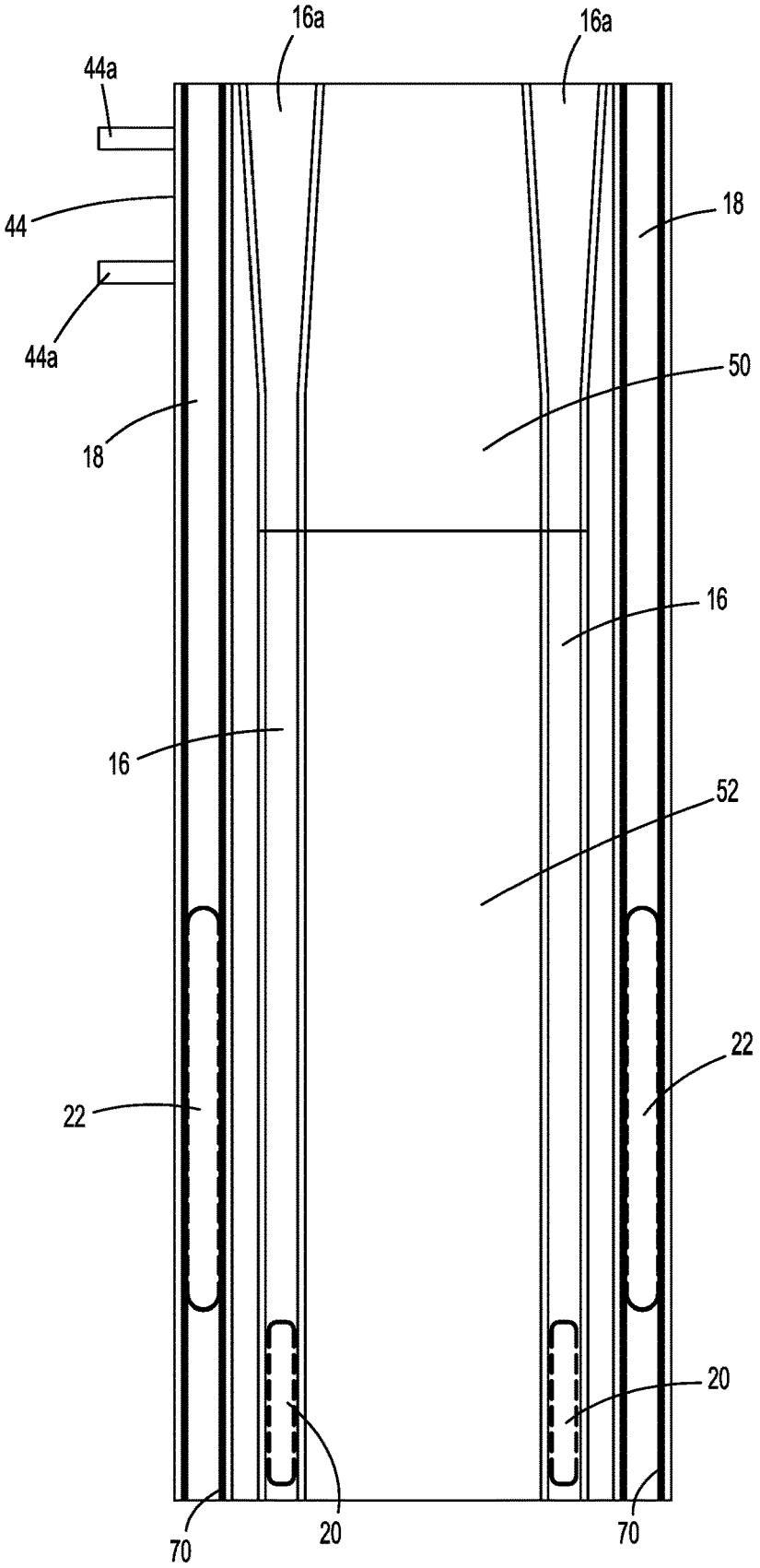
FIG. 12 is a top view of the staircase wheelchair ramp assembly shown in FIG. 11 with the staircase wheelchair ramp assembly in the deployed position and the inner support platform in the lowered position illustrating the position of the wheels of a wheelchair.

FIGS. 8-10 illustrate a wheelchair occupant 80 traversing the staircase 32 in a wheelchair 24 with the wheelchair ramp assembly 10 in the deployed position. As described above, the wheelchair ramp assembly 10 is moved to the deployed position by the wheelchair occupant 80 by pulling the retainer 46 in the direction indicated by arrow "A" in FIG. 5. When the wheelchair ramp assembly 10 is moved to the deployed position, the wheelchair occupant 80 advances the wheelchair 24 in the direction of arrow "Z" in FIG. 9 to direct the inner wheels 20 of the wheelchair 24 into the V-shaped entry portion of the inner tracks 16 of the pivotable ramp member 50 of the inner support platform 14 at the top of the staircase 32 (FIG. 8). As the wheelchair 24 moves onto the pivotable ramp member 50, the biasing member 60 compresses under the weight of the wheelchair occupant 80 such that the ramp member pivots in the direction of arrow "B" in FIG. 9 from the raised position to the lowered position (FIG. 10) at a controlled rate to allow the wheelchair occupant 80 to slowly tilt downwardly. The outer wheels 22 of the wheelchair 24 also enter the outer tracks 18 of the base platform 12 (FIG. 9). When the outer wheels 22 of the wheelchair 24 are received within the outer tracks 18 of the base platform 12, the insert 70 positioned in the outer tracks 18 engages outer surfaces of the outer wheels 22 to control the rate of descent of the wheelchair 24 down the staircase 32.

Once the wheelchair 24 moves off the pivotable ramp member 50 of the wheelchair ramp assembly 10, the biasing member 60 returns the pivotable ramp member 50 in the direction of arrow "C" in FIG. to the raised position to receive the next wheelchair occupant 80 (FIG. 10). Although not shown, the inner tracks 16 can also have an insert to further control the rate of descent of the wheelchair 24 down the staircase 32.

Persons skilled in the art will understand that the devices and methods specifically described herein and illustrated in the accompanying drawings are non-limiting exemplary aspects of the disclosure. It is envisioned that the elements and features illustrated or described in connection with one exemplary aspect of the disclosure may be combined with the elements and features of another without departing from the scope of the disclosure. As well, one skilled in the art will appreciate further features and advantages of the disclosure based on the above-described aspects of the disclosure. Accordingly, the disclosure is not to be limited by what has been particularly shown and described, except as indicated by the appended claims.

What is claimed is:

1. A staircase wheelchair ramp assembly comprising:

a base platform having a first end portion, a second end portion, a top surface extending along the first end portion and the second end portion, a bottom surface extending along the first end portion and the second end portion, and side walls extending between the top surface and the bottom surface, the top surface supporting outer tracks that extend along the length of the top surface and first inner tracks positioned between the outer tracks that extend along the top surface of the second end portion of the base platform, the outer tracks and the first inner tracks configured to receive outer wheels and inner wheels, respectively, of a wheelchair; and a ramp member pivotably coupled to the first end portion of the base platform, the ramp member having a top surface and movable between a raised position in which the ramp member projects outwardly over the top surface of the base platform and a lowered position in which the ramp member is supported on the top surface of the base platform, the ramp member supporting second inner tracks that are aligned with the first inner tracks when the ramp member is in the lowered position, the second inner tracks configured to receive the inner wheels of the wheelchair.

2. The staircase wheelchair ramp assembly of claim 1, further including a biasing member positioned to urge the ramp member to the raised position.

3. The staircase wheelchair ramp assembly of claim 2, wherein the biasing member includes a V-shaped spring formed of spring steel.

4. The staircase wheelchair ramp assembly of claim 1, wherein the outer tracks include an insert configured to frictionally engage the outer wheels of the wheelchair to limit a speed the wheelchair can move through the outer tracks.

5. The staircase wheelchair ramp assembly of claim 1, wherein the bottom surface of the base platform includes a padded layer.

6. The staircase wheelchair ramp assembly of claim 1, further including a hinge for securing one of the side walls of the base platform to a wall positioned adjacent a staircase, the hinge facilitating movement of the staircase ramp assembly between a stowed position and a deployed position, wherein in the stowed position, the staircase wheelchair ramp assembly is positioned along the staircase and in the deployed position, the staircase wheelchair ramp assembly is positioned atop the staircase to allow the wheelchair to move along the base platform over the staircase.

7. The staircase wheelchair ramp assembly of claim 6, further including a retainer engaged with the base platform to retain the staircase wheelchair ramp assembly in the stowed position.

8. The staircase wheelchair ramp assembly of claim 7, wherein the retainer includes a grip portion positioned adjacent the first end portion of the base platform.

9. The staircase wheelchair ramp assembly of claim 1, wherein the second inner tracks of the ramp member define a converging entry zone to guide the inner wheels of the wheelchair into the first inner tracks.

10. The staircase wheelchair ramp assembly of claim 8, wherein one of the side walls of the base platform includes brackets that define openings that receive the retainer to retain the staircase wheelchair ramp assembly in the stowed position.

11. A staircase wheelchair ramp assembly comprising:

a base platform having a first end portion, a second end portion, a top surface extending along the first end portion and the second end portion, a bottom surface extending along the first end portion and the second end portion, and side walls extending between the top surface and the bottom surface, the top surface supporting outer tracks that extend along the length of the top surface and first inner tracks positioned between the outer tracks that extend along the top surface of the second end portion of the base platform, the outer tracks and the first inner tracks configured to receive outer wheels and inner wheels, respectively, of a wheelchair;

a hinge for securing one of the side walls of the base platform to a wall positioned adjacent a staircase, the hinge facilitating movement of the staircase ramp assembly between a stowed position and a deployed position, wherein in the stowed position, the staircase wheelchair ramp assembly is positioned along the staircase and in the deployed position, the staircase wheelchair ramp assembly is positioned atop the staircase to allow the wheelchair to move along the base platform over the staircase; and an insert received within the outer tracks, the insert configured to frictionally engage the outer wheels of the wheelchair to limit a speed the wheelchair can move through the outer tracks.

12. The staircase wheelchair ramp assembly of claim 11, further including a ramp member pivotably coupled to the first end portion of the base platform, the ramp member having a top surface and movable between a raised position in which the ramp member projects outwardly over the top surface of the base platform and a lowered position in which the ramp member is supported on the top surface of the base platform, the ramp member supporting second inner tracks that are aligned with the first inner tracks when the ramp member is in the lowered position, the second inner tracks configured to receive the inner wheels of the wheelchair.

13. The staircase wheelchair ramp assembly of claim 12, further including a biasing member positioned to urge the ramp member to the raised position.

14. The staircase wheelchair ramp assembly of claim 13, wherein the biasing member includes a V-shaped spring formed of spring steel.

15. The staircase wheelchair ramp assembly of claim 11, wherein the bottom surface of the base platform includes a padded layer.

16. The staircase wheelchair ramp assembly of claim 11, further including a retainer engaged with the base platform to retain the staircase wheelchair ramp assembly in the stowed position.

17. The staircase wheelchair ramp assembly of claim 16, wherein the retainer includes a grip portion positioned adjacent the first end portion of the base platform.

18. The staircase wheelchair ramp assembly of claim 17, wherein one of the side walls of the base platform includes brackets that define openings that receive the retainer to retain the staircase wheelchair ramp assembly in the stowed position.

19. The staircase wheelchair ramp assembly of claim 11, wherein the second inner tracks of the ramp member define a converging entry zone to guide the inner wheels of the wheelchair into the first inner tracks.

20. The staircase wheelchair ramp assembly of claim 12, wherein the biasing member is configured to allow the ramp member to move from the raised position to the lowered position upon the wheelchair being positioned on the ramp member.

* * * * *